United States Patent [19]

Kaneko et al.

[11] 4,353,595

[45] Oct. 12, 1982

[54] HEADREST CONTROL DEVICE FOR A TREATMENT CHAIR

[75] Inventors: Kazuyoshi Kaneko, Tokyo; Katsumi Suzuki, Jyoyo, both of Japan

[73] Assignees: Kabushiki Kaisha Morita Seisakusho, Kyoto; Kazuyoshi Kaneko, Tokyo, both of Japan

[21] Appl. No.: 215,395

[22] Filed: Dec. 11, 1980

[30] Foreign Application Priority Data

Dec. 27, 1979 [JP] Japan ..... 54-180408[U]

[51] Int. Cl.[3] ..... A47C 7/38

[52] U.S. Cl. ..... 297/408; 297/61

[58] Field of Search ..... 297/408, 409, 405, 391, 297/61

[56] References Cited

U.S. PATENT DOCUMENTS

| | | | |
|---|---|---|---|
| 93,662 | 8/1869 | Archer | 297/409 |
| 337,521 | 3/1886 | Scarritt | 297/61 |
| 2,869,619 | 1/1959 | Petersen et al. | 297/408 X |
| 3,712,666 | 1/1973 | Stoll | 297/408 |
| 3,817,576 | 6/1974 | Ciavaffoni et al. | 297/408 |
| 3,929,374 | 12/1975 | Hogan et al. | 297/61 |
| 4,266,760 | 5/1981 | Matsui et al. | 297/408 |

*Primary Examiner*—Francis K. Zugel

*Attorney, Agent, or Firm*—Koda and Androlia

[57] ABSTRACT

A headrest control device for a treatment chair in which the headrest contains a linkage capable of raising and lowering a head supporting portion of the headrest in synchronized interlocking relationship with the tilting of the headrest. The device facilitates the bringing of the head supporting portion into firm contact with the rear neck region of the patient thereby making it possible for him to open his mouth in a natural posture when he undergoes oral treatment with the backrest of the treatment chair being held approximately horizontal and the headrest being slightly forwardly tilted.

4 Claims, 4 Drawing Figures

HEADREST CONTROL DEVICE FOR A TREATMENT CHAIR

BACKGROUND OF THE INVENTION

1. Field of the Invention

This invention relates to a control device for tilting a headrest with respect to a backrest in a treatment chair whose headrest is permitted to tilt forwardly and rearwardly and to be locked in any desired position with respect to the backrest of the treatment chair.

2. Prior Art

Referring to the treatment chairs of the prior art, such as the dental treatment chair shown by way of illustration in FIG. 1, there are two types of headrests heretofore in use for supporting the head of a patient in the dental treatment chair, one being the type (FIG. 1) wherein the control device for tilting the headrest and for locking the same in the position required for treatment is located outside of the headrest, and the other being the type wherein the control device is located inside of the headrest. But in both types, the head supporting portion of the headrest had the following disadvantages when a patient underwent treatment with his head being held approximately horizontal and with the mouth open while the headrest was tilted slightly forward with respect to the backrest which was moved down to an approximately horizontal position. (FIG. 1 is a longitudinal sectional side view showing the headrest portion of a prior art treatment chair in the state described above.) As apparent from FIG. 1, a head supporting portion 7 fixed to a frame 2 connected to the rear end of a support 1 is not in close contact with the rear neck region $P_1$ of a patient P in the position shown, and accordingly, the patient P is forced to open his mouth unnaturally with the rear head region being slightly raised and the chin down. Accordingly, the patient often experiences pain in keeping his mouth open and the operator himself is also forced to restrict the range of manipulation of an instrument or to take a forwardly inclined posture, and feels tired if the treatment takes a long time.

SUMMARY OF THE INVENTION

The present invention is generally directed to removing the disadvantages of the kind described above, and more specifically, the invention is directed to eliminate said disadvantages by hingedly connecting a head supporting portion to a frame of the headrest so as to permit free upward and downward opening of the head supporting portion with respect to the frame, with a linkage being provided in the headrest for bringing the headrest into a mechanical interlocking relation with the tilting of the frame, and moving the head supporting portion up and down in synchronization therewith.

A description will now be given of the invention with reference to the accompanying drawings illustrating a preferred embodiment of the invention.

DETAILED DESCRIPTION OF THE INVENTION

Figure 2:
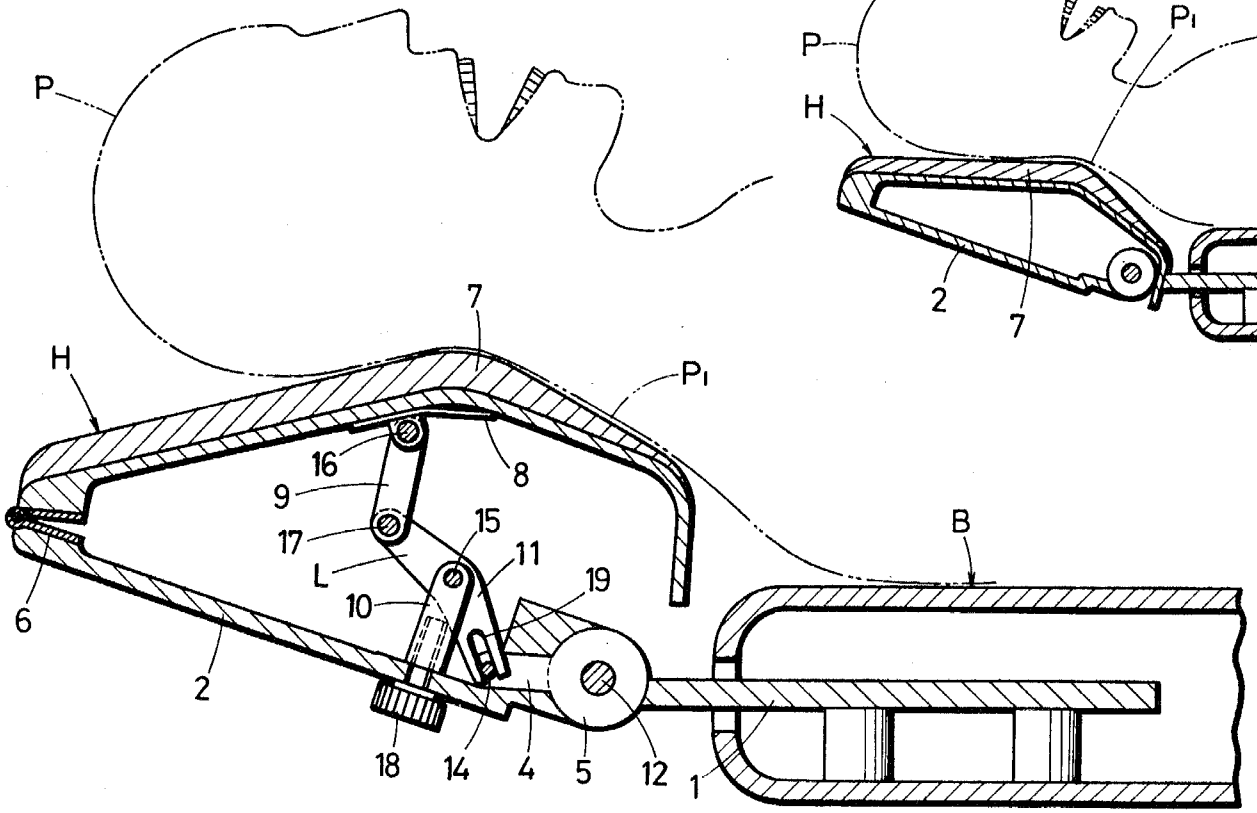
FIG. 2 is a longitudinal sectional view of a headrest control device of the present invention in which the headrest containing the device is shown in a lowered position.
Figure 3:
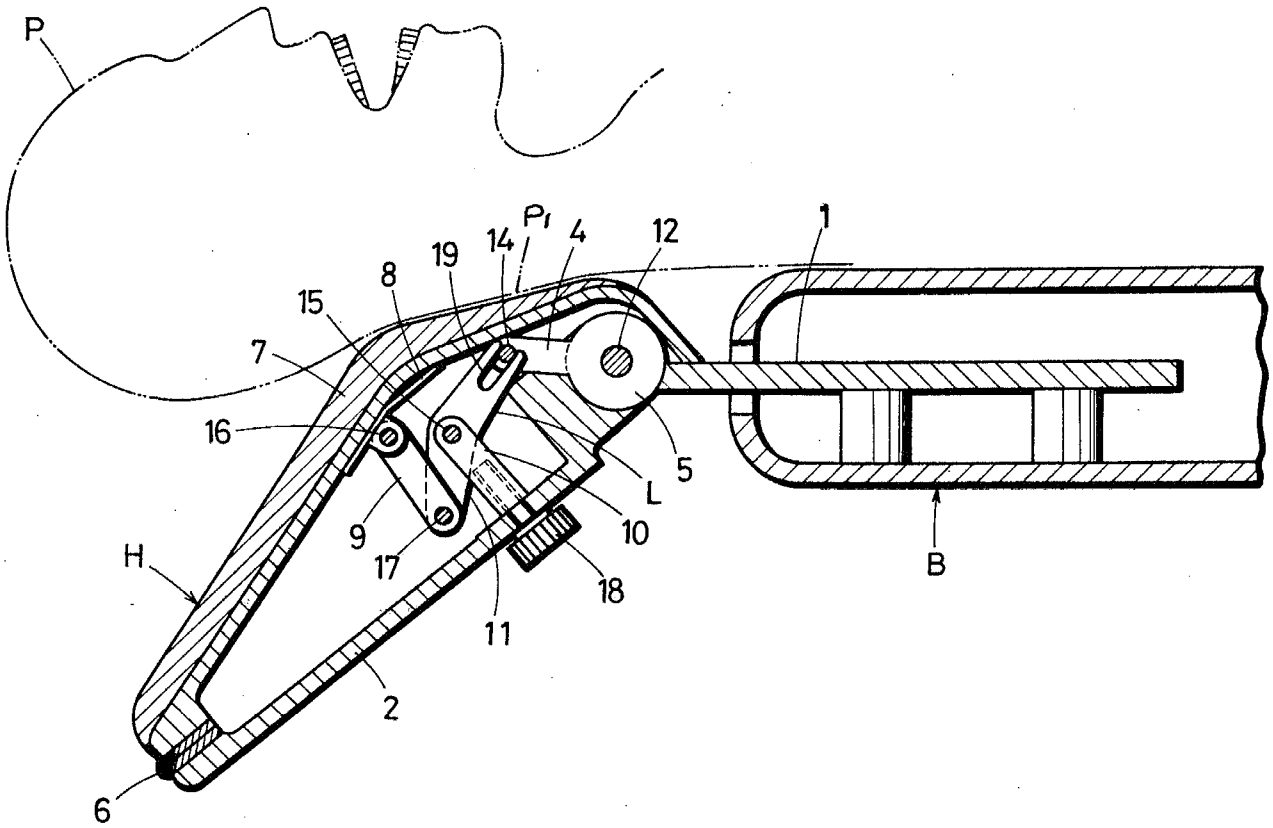
FIG. 3 is a view similar to FIG. 2 in which the headrest is shown lowered to a position lower than the position in FIG. 2.
Figure 4:
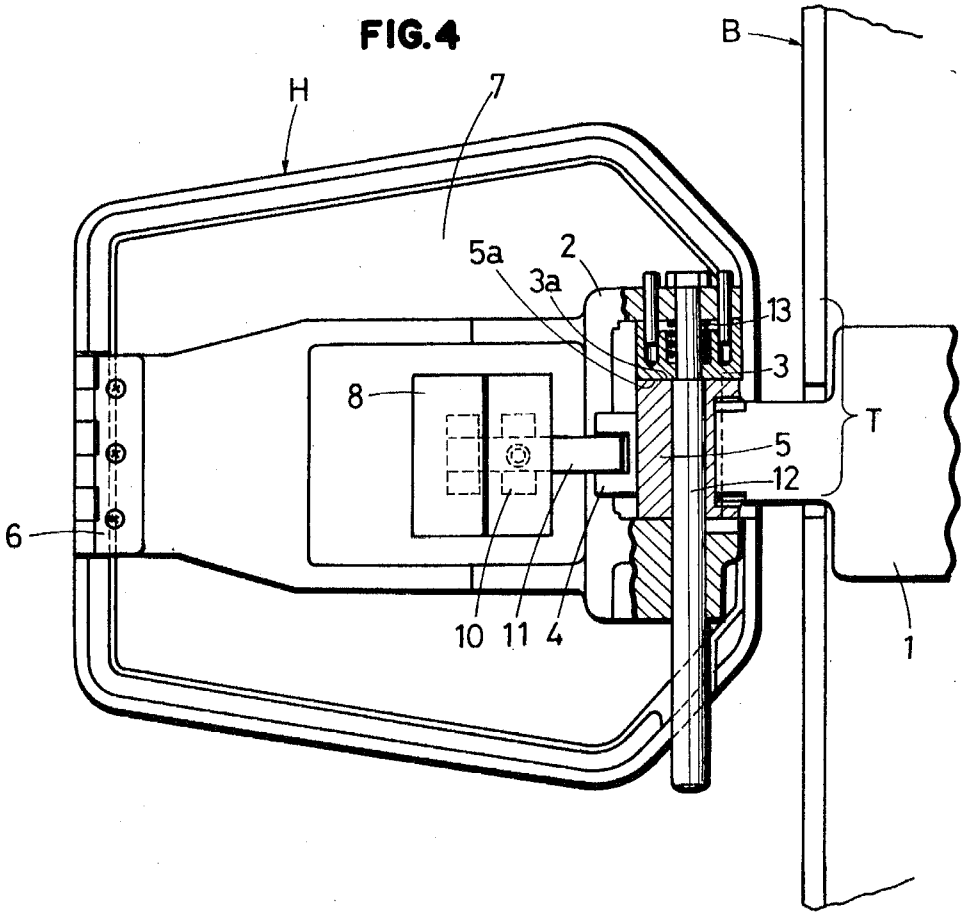
FIG. 4 is a partly longitudinal sectional back view showing the internal structure of a headrest (exclusive of the headrest frame) containing a headrest control device of the present invention.

FIGS. 2, 3 and 4 show the type of control device wherein a tilting control device for a headrest is contained in a headrest. The numeral 1 designates a headrest support provided in a backrest B and a headrest frame 2 connected through a tilting control device T to the rear end of the support 1. A head supporting portion 7 formed independently of the frame 2 is connected hingedly to the frame by a hinge means 6 at the rear end of the frame so as to permit the free upward and downward movement of the portion 7 with respect to the frame 2. Inside a headrest H is provided a linkage L which pushes up the head supporting portion 7 as the headrest is tilted in a forward direction and which brings down the portion 7 as the headrest is tilted in a rearward direction, thereby providing a synchronized interlocking relationship to the tilting of the headrest H, with the hinge means 6 functioning as a pivot. The linkage L comprises a lever 11 pivotally secured to a support piece 10 mounted on the frame 2 by a pin 15 so as to be free to swing fore and aft, a link 4 which is pivotally connected at one end to the lever 11 by a pin 14 freely movable along a slot 19 at the rear end of the lever 11 and which is fixed at the other end to a rotary bearing 5 connected to headrest support 1, and a link 9 pivotally connected by a pin 17 to one end of the link 11 and hingedly connected at the other end to the head holding portion 7 through a second hinge means 8. The support piece 10 is fitted with an adjusting knob 18 so as to permit the adjustment of the height of the piece 10 by operation of the knob 18.

The tilting control device may be locked and unlocked at will with respect to the forward and rearward tilting of the headrest H and more particularly the device may be the headrest tilting control device disclosed in Japanese Utility Model Application No. 183386/1979 (USA Pat. appl. Ser. No. 6/121,500; West German Patent appl. No. P3003 202.9) all of which being assigned to the same assignee as the instant application, and which are accordingly incorporated herein by reference. In as much as the tilting control device disclosed in the above-cited applications is not indispensable for the practice of the present invention, but other tilting control devices may also be applicable and, since said device is disclosed in detail in said prior applications, a brief description of the device T with reference to FIG. 4, will suffice for present purposes. In FIG. 4, the device T comprises a rotary bearing 5 having a first radial ratchet 5*a* at one side end thereof, a support shaft 12 rotatably carried by the bearing 5 and permitted to move axially with respect thereto, a ratchet wheel 3 having at one side end face thereof a second radial ratchet 3*a* capable of making meshing contact with said first ratchet 5*a*, said wheel 3 being also supported about the support shaft 12 so as to be prevented from rotating circumferentially but permitted to move axially therewith, and a spring means 13 resiliently pressing the ratchet wheel 3 therewith in a first direction so as to bring the ratchet 5*a* into meshing contact with the ratchet 3*a*. The ratchet 5*a* may be disengaged from the ratchet 3*a* by pressing the shaft 12 in a second direction against the action of the spring means 13. The structure of the device described is such that, if the ratchets 5*a* and 3*a* are brought out of meshing by axially pressing the shaft 12, the headrest H is rendered tiltable in either a forward or a rearward direction about the shaft 12 and if the pressing force applied to the shaft 12 is relaxed with the headrest at a desired tilted position, the ratchet 5*a* is brought into meshing contact with the ratchet 3*a* by the spring means 13 to thereby lock the headrest H in the desired tilted position.

Figure 1:
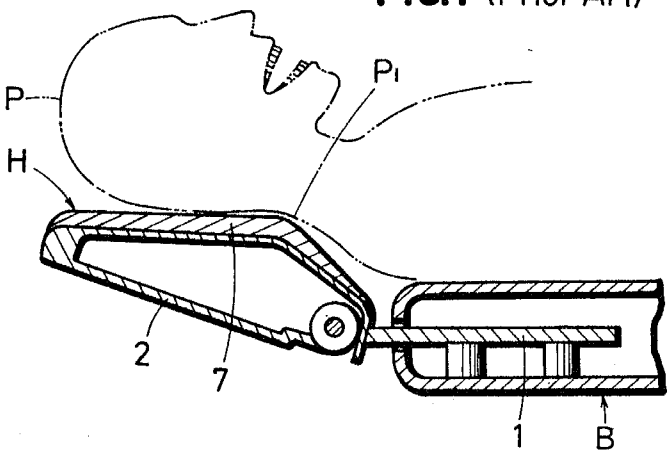
FIG. 1 (Prior Art)
FIG. 1 illustrates a prior art headrest control device.

From the above described structure of the control device of the present invention, it will be understood that when the headrest H is allowed to tilt forwardly or rearwardly by axially pushing the shaft 12, the linkage L operates in synchronized interlocking relationship with the tilting to thereby push open the head supporting portion 7 with respect to the frame 2 through a hinge means 6 as the headrest is tilted in the forward direction and thereby to raise the portion 7, and conversely to close and lower the portion 7 as the headrest is tilted in the rearward direction. When the backrest B shown in FIG. 2 is in a down, approximately horizontal, position and when the headrest H is held slightly forwardly tilted, the head supporting portion 7 is brought into close contact with the rear neck region $P_1$ of a patient P and pushes the region $P_1$ upwardly and accordingly the patient P, in contrast to the situation shown in FIG. 1, is enabled to open his mouth with his chin down, and is thereby relieved of pain. When the headrest H, as shown in FIG. 3 is tilted more rearwardly than that in FIG. 2, the portion 7 is lowered and the patient is enabled to keep his posture suitable for treatment with no feeling of pain in opening his jaws.

It is apparent that adjustment of the height of the support piece 10 by means of the adjusting knob 18 makes possible fine adjustment of the elevation of the head supporting portion 7. The tilting control device T illustrated is shown as being of the type in which the device T is contained inside the headrest H, but it is apparent that the device T may be mounted inside the backrest B, or a structure other than the one described in the above referenced prior application may be used therefor.

As described above, the present invention makes it possible to move up and down the head supporting portion of the headrest in an interlocking synchronized relationship with the tilting of the headrest. Accordingly, if the head supporting portion corresponding to the rear neck region of a patient is moved upwardly for treatment when the headrest is tilted forwardly and the backrest is about horizontal, the patient is enabled to open his mouth in a natural posture without being forced to draw his chin downwardly, and the invention thus offers the advantage of making it possible to practice treatment with minimal pain or fatigue for either the patient or the doctor.

The description above has been given of a preferred embodiment of the invention, but it should be understood that the invention is not limited to the embodiment illustrated but various other replacements, modifications and additions may structurally be possible without departing from the scope and spirit of the appended claims for the invention.

We claim:

1. A headrest control device for a treatment chair of the type wherein a headrest having a head supporting portion above a headrest frame is tiltable forwardly and rearwardly and lockable with respect to a headrest support mounted to a backrest, said control device comprising:

a tilting control device mounted to said headrest support for locking and unlocking the rearward tilting of said headrest with respect to said support, hinge means for permitting the opening and closing of said head supporting portion with respect to said headrest frame, and linkage means contained in said headrest and responsive to the tilting thereof for opening said head supporting portion as said headrest is caused to tilt forwardly and for closing said head supporting portion as said headrest is caused to tilt rearwardly.

2. A device according to claim 1 wherein said linkage comprises a lever secured pivotally by a first pin to a support piece mounted to said headrest frame, a first link having a first end mechanically engaged with said lever by a second pin connecting with a slot at the rear end of said lever and having a second end fixedly mounted with respect to said headrest support, and a second link pivotally connected at one end by a third pin to a front end of said lever and hingedly connected at the other end to said head supporting portion.

3. A device according to claim 2 wherein said support piece is adjustably mounted to said headrest frame by means of an adjusting knob.

4. A device according to claim 2 wherein said tilting control device comprises a rotary bearing attached to said headrest support and having a first radial ratchet at one side end face thereof, a support shaft rotatably carried by said bearing and allowed to move axially with respect thereto, a ratchet wheel having at one side end face thereof a second radial ratchet meshable with said first ratchet, said wheel being supported about said support shaft so as to be prevented from rotating circumferentially but allowed to move axially therewith, and spring means normally resiliently pressing said wheel in a first direction to thereby bring said first ratchet into meshing engagement with said second ratchet, wherein pressing of said shaft in a second direction opposite to said first direction results in the disengagement of said first ratchet from said second ratchet.

* * * * *